US008371793B2

(12) United States Patent
Fäβler et al.

(10) Patent No.: US 8,371,793 B2
(45) Date of Patent: Feb. 12, 2013

(54) PARKING SYSTEM FOR MOTOR VEHICLES

(75) Inventors: Norbert Fäβler, Rot an der Rot (DE); Dieter Melder, Türkheim (DE)

(73) Assignee: Klaus Multiparking GmbH, Aitrach (DE)

( * ) Notice: Subject to any disclaimer, the term of this patent is extended or adjusted under 35 U.S.C. 154(b) by 913 days.

(21) Appl. No.: 11/793,213

(22) PCT Filed: Dec. 16, 2005

(86) PCT No.: PCT/EP2005/013570

§ 371 (c)(1),
(2), (4) Date: Jun. 18, 2007

(87) PCT Pub. No.: WO2006/066815

PCT Pub. Date: Jun. 29, 2006

(65) Prior Publication Data

US 2008/0155906 A1 Jul. 3, 2008

(30) Foreign Application Priority Data

Dec. 17, 2004 (DE) ..... 20 2004 019 695 U
Mar. 24, 2005 (DE) ..... 10 2005 014 282

(51) Int. Cl.
*E04H 6/00* (2006.01)

(52) U.S. Cl. ..... 414/229; 414/240

(58) Field of Classification Search ..... 414/228, 414/229, 227, 233, 234, 239, 240, 253, 258, 414/643, 655, 678, 680, 696; 52/29; 187/203, 187/207, 216, 265, 274; 254/2 C, 3 C, 3 R, 254/4 C, 4 R, 45, 47, 50, 89 H, 89 R, 91, 254/93 L, 264, 266, 389, 390, 391, 405
See application file for complete search history.

(56) References Cited

U.S. PATENT DOCUMENTS

| | | | | | |
|---|---|---|---|---|---|
| 3,387,722 | A | * | 6/1968 | Biddle, Sr. et al. | 414/229 |
| 3,559,557 | A | * | 2/1971 | Schwartz et al. | 134/58 R |
| 3,697,048 | A | * | 10/1972 | Sarno | 187/242 |
| 3,706,356 | A | * | 12/1972 | Herbst et al. | 187/213 |
| 3,861,540 | A | * | 1/1975 | Lendi et al. | 414/229 |
| 3,924,760 | A | | 12/1975 | Lendi | |
| 3,941,257 | A | * | 3/1976 | Matsuura | 414/233 |
| 3,942,821 | A | * | 3/1976 | Bock | 280/277 |
| 3,985,207 | A | * | 10/1976 | Petit | 187/208 |
| 4,015,733 | A | * | 4/1977 | Woehr et al. | 414/249 |
| 4,230,205 | A | * | 10/1980 | Darwent | 187/265 |
| 4,486,140 | A | * | 12/1984 | Klaus | 414/229 |
| 4,551,054 | A | * | 11/1985 | Klaus | 414/229 |
| 4,674,938 | A | * | 6/1987 | Van Stokes et al. | 414/228 |

(Continued)

FOREIGN PATENT DOCUMENTS

| | | |
|---|---|---|
| DE | 2 013 384 | 11/1971 |
| DE | 2 354 227 | 6/1974 |

(Continued)

*Primary Examiner* — Saul Rodriguez
*Assistant Examiner* — Glenn Myers
(74) *Attorney, Agent, or Firm* — Jacobson Holman PLLC

(57) ABSTRACT

The invention refers to a storage device for vehicles. It comprises several platforms arranged one above the other. The platforms can be lifted or lowered between a first lower and a second upper position. By means of that the platform can optionally be connected to a common approach way. Preferably the platforms are guided at a stand. The platform can be fixed in its respective position at the stand by a support or a stopper.

23 Claims, 11 Drawing Sheets

U.S. PATENT DOCUMENTS

Figure 1:
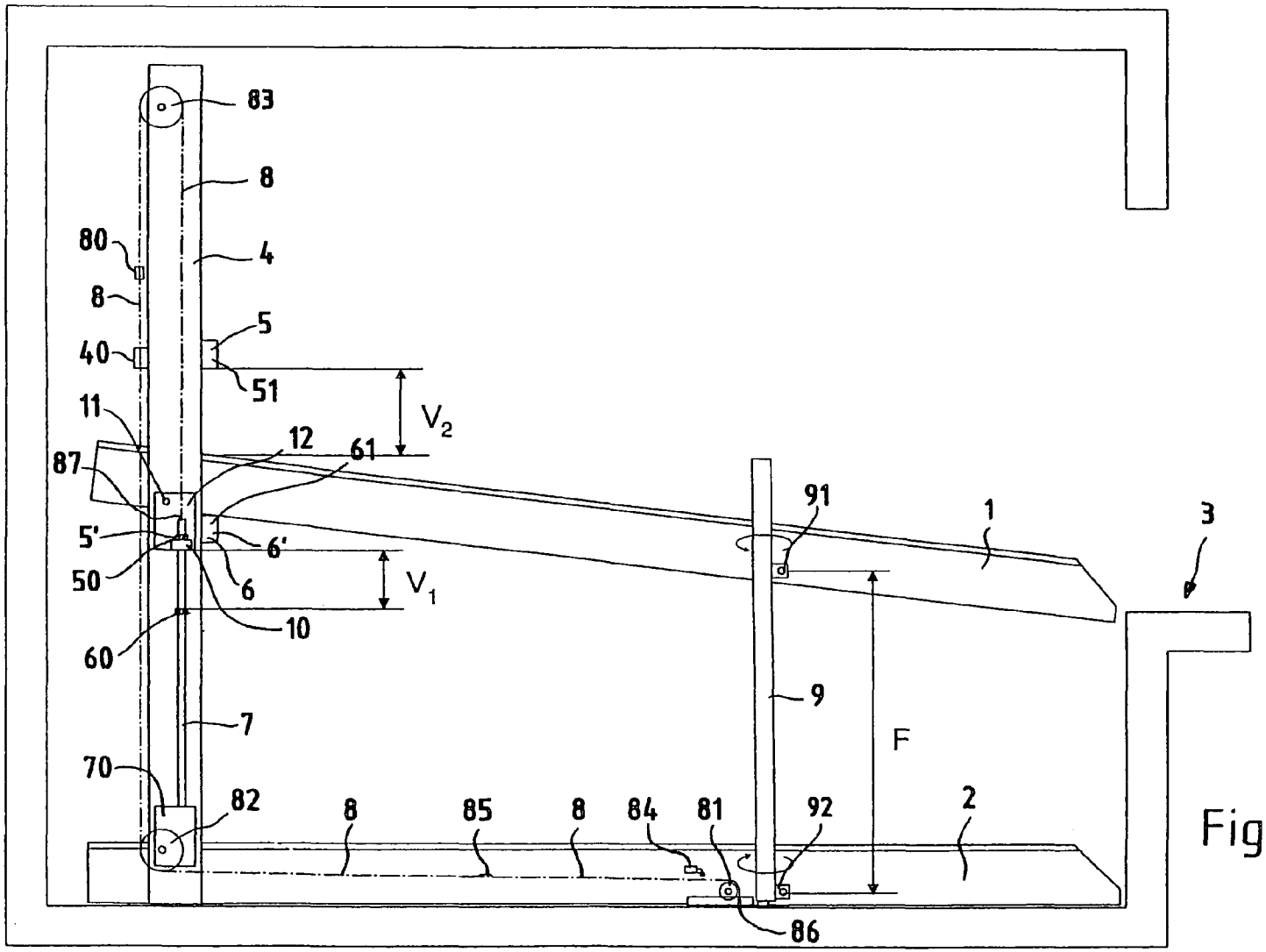

| | | | | | |
|---|---|---|---|---|---|
| 4,772,172 | A | * | 9/1988 | Rosen | 414/240 |
| 4,804,066 | A | * | 2/1989 | Fusaro et al. | 187/210 |
| 4,892,452 | A | | 1/1990 | Moynihan | |
| 5,018,925 | A | * | 5/1991 | Ganser | 414/240 |
| 5,035,562 | A | * | 7/1991 | Rosen | 414/240 |
| 5,080,541 | A | * | 1/1992 | Andre | 410/24.1 |
| 5,158,413 | A | * | 10/1992 | Wu | 414/228 |
| 5,335,755 | A | * | 8/1994 | Miller | 414/249 |
| 5,772,360 | A | * | 6/1998 | Wood, II | 405/3 |
| 5,830,116 | A | * | 11/1998 | Gautier | 482/99 |
| 6,048,156 | A | * | 4/2000 | Huang | 414/234 |
| 6,106,210 | A | * | 8/2000 | Toxer | 414/234 |
| 7,160,075 | B1 | * | 1/2007 | Blackmore | 414/229 |

FOREIGN PATENT DOCUMENTS

| | | | |
|---|---|---|---|
| DE | 23 01 428 | | 7/1974 |
| DE | 2301428 | | 7/1974 |
| DE | 25 43 947 | | 7/1976 |
| DE | 30 26 746 | | 2/1982 |
| DE | 37 39 286 | | 6/1989 |
| DE | 296 05 779 | | 5/1996 |
| DE | 297 22 678 | | 4/1999 |
| DE | 29722678 | U1 | 6/1999 |
| DE | 198 49 444 | | 5/2000 |
| EP | 0 088 304 | | 9/1983 |
| EP | 0589120 | A1 | 3/1994 |
| GB | 1 457 774 | | 12/1976 |
| GB | 1 524 563 | | 9/1978 |

* cited by examiner

PARKING SYSTEM FOR MOTOR VEHICLES

This is a national stage of PCT/EP05/013570 filed Dec. 16, 2005 and published in German.

The invention refers to a storage device for vehicles with several platforms one above the other which can be lifted and lowered at least between a first lower and a second upper position, and can be connected optionally to a common approach way, the platforms being guided on at least one stand.

Storage devices as described in the beginning have been known for a long time. They are used, for example, to increase the available storing areas for vehicles in parking garages or basement garages. Through the known storage devices the number of parked cars on known ground plans can be increased considerably.

Known arrangements have, for example, several lifting drives in order to move each of the platforms arranged one above the other. For a coordinated movement, in particular to prevent the parked car from being damaged, a suitable control is provided.

As the platforms are supported in the approach zone as well as in the region facing the approach zone, for example by suitable lifting drives, the position of the platforms is at any time defined exactly. This requires considerable expenditure, as lifting devices have to be used, for example at the font and back end of the platforms. It has to be taken into consideration here that the lifting devices are provided double in longitudinal direction to support the platforms each time on the left and right hand side.

Coming from this state of the art it is the object of the invention to provide a storage device as described in the beginning, the expenditure for which, in particular the expenditure for realization, is less.

In order to solve this problem the invention suggests first of all that the platform can be fixed in the respective position by a support and a stopper at the stand.

The platform rests in the respective position on a support, that means the weight of the platform is held by the support. Then, as a rule, only one degree of freedom upward remains. If now the platform is supported flexibly, as it is the case, for example, with the lifting drive, a seesaw effect may appear which is not desired. However, if it is provided that the platform in the respective position can be fixed by a support and a stopper at the stand, the platform, in particular in the position where it is driven on, that means in the position where a vehicle enters or leaves, is guided safely and reliably.

The modification according to the invention makes it possible that an individual lifting drive in the region of the stand is not necessary. The lifting motion is then deviated, for example, by suitably arranged tension elements by a central lifting device. Therefore the expenditure for the storage device according to the invention is very low.

Furthermore in the state of the art storage devices are known which, as described, which are distinctive, and are already provided with a lifting drive interacting with a tension element for lifting and lowering the platform.

According to the invention for this type of storages it is suggested that a tension element length compensation is used by means of which the length of the tension element, in particular during the lifting/lowering operation, can change. On the known tension elements the movement of the platforms is controlled in a suitable way by the use of chain stoppers arranged on the tension element. If the chain stopper is at a stopper the tension length of the tension element is shortened accordingly. The result is then that the (the remaining, not used) tension element is stored possibly uncontrolled and, for example, interferes with other elements of the device, for example such that the storage device is blocked. However, if, according to the invention, it is suggested that a tension element length compensation is used, on the one hand, the operational safety of the storage device according to the invention increases considerably, and, on the other hand, the expenditure for a protection from the non-stored tension elements which is necessary otherwise is saved. The invention designed in that way thus contributes for keeping the expenditure for realization low as well as for minimizing the effort for maintenance.

The solution now suggested according to the invention achieves surprising facts as a relatively complicated kinematic movement, namely, first of all, a turning movement of the platform, which is, after that, followed by a lifting of the platforms, is reached with one and the same simple kinematic means, namely a lifting drive which interacts with a tension element for lifting and lowering the platforms. Here the lifting drive is provided, for example, at one side at the storage device (or the platform, respectively), and the tension element takes over in a proper way the movement for the other end of the platform. By means of this suggestion according to the invention the problem phrased in the beginning is solved more than sufficiently. The invention provides a means through which it is also possible to realize comparatively difficult paths of movement of the platforms in order to be able to use the storage devices, for example, also for difficult applications without being forced to change, however, the storage device altogether. It is entirely sufficient to set and thus to vary, for example, the kinematics of the storage device with adjustment means, for example the length of the tension element and the arrangement of chain stoppers on the tension element. Eventually this suggestion widens the variability of the entire invention considerably which will be further discussed later on.

The invention furthermore also suggests solutions where, for example, a coupling or the like is provided by means of which, for example, a mixed movement may occur between the turning movement and the longitudinal movement. The movement of the storage device is here reached by an accordingly suitable control of the active tension lengths of the tension element.

In the frame of the invention, of course, also storage devices are comprised which integrate several or all of the above-mentioned, individually shown solutions.

It is convenient that for the respective positions in which a platform can be shifted to also each time a support and a stopper for fixing the platform in this position is provided. Therefore for the lower position a lower support and a lower stopper, and for the upper position an upper support and an upper stopper are provided. In this connection it has to be emphasized that the term "position" refers to the position of the platform with regard to the stand and not to a connecting of the platform to the approach way. Thus, for example, in the lower position a lower platform is not in the approach zone, the upper platform arranged above it, however, can, in the lower position, be driven on, for example. If then the storage device moves such that the upper platform runs in an upper position, the lower platform will get at the approach way and can be walked or driven on accordingly.

It has been found in particular in a modification according to the invention to be convenient that fixing of a first, for example, lower platform is carried out by a second platform arranged for example underneath. In a simple embodiment of the storage device, for example, only two platforms are arranged one above the other. These two platforms are, on the one hand, connected to each other through the stand or corresponding guide elements at the stand, and, on the other hand, by the lifting drive, the respective connection points being flexible. The body resulting from that may be seen as oblique lozenge, the respectively opposite sides being not exactly parallel. The geometric relations are accordingly complex. However, it is important here that the lower platform is connected flexibly mechanically with the upper platform. The design according to the invention therefore makes it possible by fixing the first, for example, upper platform to fix also the lower platform if, for example, exactly the lower platform has to be fixed accordingly for loading or unloading, that is entering or leaving of a vehicle. This is a considerable advantage as the expenditure for designing the stoppers and supports can be reduced accordingly. Finally a pair of stopper-support is used in the respective position in order to stiffen the complete flexible arrangement of the two platforms for parking in and parking out the vehicles or for loading or unloading with other goods and to fix it, for example, at the stand.

In a modification according to the invention it is suggested that at the stand a stopper and a support is arranged fixedly, at least during the operation of the storage device. Thus a stationary stopper or a stationary support is defined at the storage device which, for example, defines corresponding terminal positions of the storage device because of the construction. A stand in the sense of the invention is here a solution which holds the weight of the platform, if necessary together with the vehicle, as well as a solution where a separate stand is used which does not serve or serves only partly for holding the weight. This stand may be supported by the floor or the wall.

However, the invention leaves it open to design variably in another modification of the invention the support arranged at the stand or the stopper in the respective position at the stand. This can be realized, for example, by a suitable screw attachment. The effect of this relatively simple measurement, however, is considerable. By a simple shifting of the support or the stopper the position is altered. The measurement is thus suited to adjust the position of the platform in the storage device accordingly.

This advantage according to the invention makes it possible, for example, to adjust the storage device exactly on site during assembling.

Besides this first group of the support or the stopper fixed with regard to the movement of the platforms, however, the invention also suggests a second modification. The invention provides that with regard to the stand a longitudinally movable stopper or support is provided. This longitudinally movable stopper or support, namely, makes it possible to act supporting and guiding during the movement of the platform, it is only important when the respective position, for example the lower or upper position, is reached to fix the stopper and the support accordingly.

The invention leaves it open here whether the stopper and the support both are fixed, are movable or whether for example a movable stopper is combined with a stationary support, or vice versa a movable support is combined with a stationary stopper.

In this connection the invention comprises also supports and stoppers which can be activated on demand, that means, for example, they can be turned in the respective path of movement of the platform. Also embodiments of this kind are part of the invention.

Cleverly a longitudinally movable stopper or a longitudinally movable support is arranged directly in this way at one of the platforms.

In a preferred modification of the invention it is suggested here that the storage device has a lifting rod, and the lifting rod has a support and a stopper.

The lifting rod is designed, for example, as threaded rod, and support and stopper can be adjusted and fixed by suitable threaded nuts at the threaded rod.

The invention suggests here another possibility for designing the position of the platforms to each other accordingly in a way that they can be adjusted. When chosen cleverly here the position of the upper platform can accordingly be influenced independently from the position of the lower platform.

It is, for example, possible, by the respective position of the stopper either at the stand or on the lifting rod, to adjust the respective angle position of the platforms during parking in and out. Thus the platform additionally reaches the advantage to create a storage device which is extremely flexible in its field of application, as it can be adjusted very simply to different mounting arrangements. Eventually only the respective stoppers have to be shifted in order to reach the desired entering and leaving conditions. The effort for adjusting here is minimal, the effect considerable as a high number of variations can be reached with this storage device according to the invention.

In a preferred embodiment of the invention it is provided that the lifting rod can be lifted and lowered with the movement of the platform. Conveniently thus the lifting rod is connected flexibly with the platform, preferably with the lower platform. In this connection the lower platform is the platform which is directly beneath the lower platform.

Conveniently with the platform a carrier is connected flexibly, and the carrier interacts with the support or the stopper of the lifting rod. The carrier counts as a part of the platforms. The invention extends in this respect, of course, also to such a design where the platform is not fixed directly, but indirectly by a carrier or another element by the support and a stopper. Here it is, in the sense of the invention, of course also identical whether now the support interacts with the carrier of the platform or the stopper at the platform interacts directly with it.

The invention is not restricted, either, to the solution that the carrier interacts only with the support or the stopper of the lifting rod. It is, of course, also possible that the carrier interacts with both elements according to the invention. Preferably here the upper platform is equipped with a carrier, in particular if the lifting rod is attached at the lower platform arranged directly below the upper platform. As, on the one hand, the lifting rod is connected flexibly with the lower platform, and, on the other hand, the carrier interacting with the lifting rod is connected flexibly with the upper platform, the result here is a C which is flexible at its corner points which is accordingly fixed and stiffened by the use of support and stopper according to the invention. The invention comprises arrangements where a stand is used, usually, however, the platform is one beside the other between two stands each arranged laterally, if necessary also for several parking spaces.

Conveniently for the platforms a lifting drive is provided. Usually one storage device according to the invention has two lifting drives positioned at the same point with regard to the longitudinal axis, which are arranged left and right besides the platform. The lifting drives are designed, for example, as hydraulic cylinder or electro motors or the like. The lifting drive is here connected flexibly with the platforms so that a suitable anti-parallel movement of the platforms is possible.

In a similar way it is also provided that the platforms are guided supported flexibly in sledges movably at the stand.

The two sledges are here independent from each other, the lifting rod connects, for example, the two sledges or the two platforms, respectively.

In a preferred embodiment of the modification of the invention a tension element is provided for the platform. Preferably the invention is realized with one lifting drive or with lifting drives on one side of the storage device (or platform). Because lifting drives are saved the expenditure altogether for the storage device according to the invention is reduced accordingly. However, in order to move reliably the platform, which has a suitable length (a vehicle should be parked on it), finally an arrangement which impresses the lifting or lowering movement in the platform should be provided at the respective platform ends. Cleverly a tension element is used for that which is able to interact in a suitable way with the lifting drive, and thus it reaches corresponding lifting and lowering movements, even at the end of the platform where no lifting device is arranged.

It is basically also possible to arrange in the front as well as in the back platform region one suitable tension element each which interacts with the lifting drive which is, for example, in the center of the platform. Here the tension element is deviated with suitable deflection rollers in a suitable way.

Conveniently a pulley block-like element is provided for the platform. A pulley block-like element is in particular characterized in that a stationary and a movable deflection roller is provided over which the tension element, for example a rope or a chain or the like, is guided.

In a preferred modification of the invention it is suggested that the length of the tension element is, at least in sections, a result of the position of the lifting drive.

As described in the beginning the invention also comprises a solution where a tension element length compensation is provided by means of which the length of the tension element can vary. Through the suggestion according to the invention the entire length altogether of the tension element, at least in sections, is determined by the position of the lifting drive. The entire length of the tension element is defined here by the length along the tension element which follows from length between the two terminal points of the tension element. This length is, as a rule, larger, at best the same size as the tension length of the tension element. The tension length is defined by the position of the chain stopper on the tension element until one end (for example the fixed end) of the tension element.

At the beginning of the lifting movement (if the storage device is in the lower position), according to the suggestion of the invention, the lifting drive will act only on one side of the platform, as far as the lifting drive interacts with the tension element, the power impressed there is used for enlarging the length of the tension element by lengthening the tension element length compensation. Thus the result is a change of the length of the tension element depending on the position, that is the position of the lifting drive. This connection, however, does not necessarily be for the complete lifting region of the lowering device, by a suitable subdivision very different kinematics can be reached.

Cleverly on the tension element a chain stopper is set in which interacts in a suitable way with a catch stopper at the device, preferably at the stand. As described, by means of the chain stopper the tension length of the tension element is set, and, when the chain stopper is in contact with the catch stopper, also the tension length is reduced accordingly.

The invention may be designed, for example, in such a way that in a first modification a large tension length is separated by the chain stopper into a smaller chain length, or the tension element is only activated when the chain stopper is in contact with the catch stopper and thus defines the tension length. Thus the invention results in a wide field of application which can be used in a suitable way, for example, for the kinematics of the platforms which have to be moved. The variability of the invention is her considerable.

Thus it is, for example, provided, according to a development of the invention, that the contact of the chain stopper at the catch stopper changes the direction of movement of the platform in the lifting or lowering movement.

The direction of movement in the sense of this invention is here the path of movement which the center of gravity of the respective platform carries out. The direction of movement may be here a circular path (for example when turning) or a longitudinal movement or mixed forms of them. Thus it is, for example, possible according to the invention that a lifting movement follows after the rotational movement, or a lifting movement after a combined rotational-lifting movement, and so on. Eventually at the time when the chain stopper runs against the catch stopper or is in contact with it, a discontinuity in the direction of movement is reached, that means the direction of movement changes. This change of direction results, of course, in a change of power, that means an additional input of power at an end of the platform or a corresponding elimination of power at a certain point.

An in particular flexible tension element is convenient as it allows a deviation of the directions of power at the storage devices in any way. Thus it is, for example, provided according to a modification of the invention that one end of the tension element, independent from the position of the platform, is fixed, for example, in the wall or the floor, the tension element is deviated, after that, by a first deflection roller at the platform, preferably at the lower platform, the platform, preferably the lower platform has a second deflection roller for deviating the tension element in the direction of a third deflection roller arranged at the stand, and the other end ends at the lower and/or upper platform and is connected with it.

By fixing the end of the tension element, for example in the wall or the floor, the use of the lifting drive effects a movement of the tension element so that a corresponding force is transferred via the mentioned second and third deflection rollers to the platform, either the upper or the lower one. The invention makes it possible here that the tension element is connected to the upper as well as to the lower platform, that means the platform which already carries the two deflection rollers. In this respect the invention can be applied very variably.

However, the variability is even enhanced by the other modification according to the invention according to which the other end of the tension element, that means the end which is not connected with the wall or the floor is connected to the lifting rod. By means of that the entire design gains a high variability as by adjusting the stoppers or the support on the tension rod the effective length of the tension element is variable and can be set. This design allows even another modification described further below.

In this connection it is convenient that a synchronising device is provided for the sides of the platforms. This synchronising device is, for example, realised by a chain which is stiff during pushing which is arranged in particular in the connection region of the tension element designed as chain from the floor until the first deflection roller.

Such a synchronising device is designed as flat links the brackets of which carry at least partly on the side opposite the deflection roller thrust pieces which in the extended condition of the chain are positioned one beside the other and thus are able to transmit pressure forces.

In another embodiment of the invention it is provided that the tension element carries a chain stopper between the second and the third deflection roller. The chain stopper thus is provided in the section of the tension element extending usually vertical essentially parallel to the stand. The chain stopper effects, if interacting with a catch stopper, a disengaging of a part of the tension element from the tension effect.

Cleverly the stopper catch is arranged at the device or the stand. In a preferred embodiment of the invention it is provided that the position of the chain stopper on the tension element can be set. This is a third possibility to change the behaviour of the storage device with regard to the movement of the platforms and the angle for parking in and out of vehicles. It has to be taken into consideration that the upper platform moves on its way from the first to the second position, for example from below to above, in sections with different speed and this region with different speeds depends on the position of the chain stopper. Eventually the chain stopper interacting with the stopper catch has the effect that the upper part of the pulley-like tension element is "switched off". Thus the deviation around the third deflection roller is deleted, and thus a corresponding lowering, exactly division in two of the speed of the lower platform.

Cleverly here the position of the chain stopper on the tension element is chosen depending on the position of the support on the tension rod with regard to the carrier of the upper platform. During the first part of movement the upper platform is moved by the lifting rod which is pulled from above through the tension element. If the chain stopper is active the region above the third deflection roller of the tension element becomes powerless, and the lifting rod transmits the power completely via the second deflection roller arranged movably at the lower platform and also at the same time supporting the lifting rod at the bottom.

In this case then the support of the tension rod interacts with the carrier.

The invention suggests that the tension element length compensation can be designed, for example, as spring, telescope cylinder and/or tension element storage. The tension element length compensation is designed suitably, for example elastically, the elasticity counteracting the power impressed because of the lifting drive. Uncontrolled depositing of the tension element is avoided safely by this suggestion according to the invention, the tension element is always guided and controlled securely so that malfunctions cannot occur. It is, for example, possible, that the tension element length compensation is designed as spring, the spring being able to elongate under the impression of the lifting force, and thus the entire length of the tension element is enlarged accordingly. The term spring has to be understood first of all concretely, that means for example at the tension element which is designed for example as a chain, there is a flat spiral spring or the like mounted at the end or center. The term spring, however, is also to be understood in functional respect, namely that for example the springy, that means elastic, element, for example a rubber band, is arranged parallel to the tension element, and the unstressed tension element is stored because of the rubber band or the other elastic element, accordingly controlled.

Besides the use of a spring, of course, also the use of a telescope cylinder is possible, the cylinder being telescoped for example against a suitable spring force.

Also the use of a tension element storage, for example of a sort of a cable roller or the like, is possible according to the invention. The use of a tension element storage has in particular the advantage that also a protection for the tension element is possible when, for example, the tension element is deposited in a housing or the like.

It is, according to the invention, possible that the tension element length compensation is arranged between the chain stopper and the end of the tension element connected either with the stand or the lifting rod. These designs will be in particular described further by the drawings, in these modifications the tension element length compensation is usually not arranged in the region of the tension element which is arranged at the lifting drive. In such a modification the access of the tension element length compensation may be considerably easier.

In a modification according to the invention the tension element length compensation, for saving reasons, will not be arranged in the region where then considerable lifting loads will be deviated for the respective platform region. Basically, however, it is possible to arrange the tension element length compensation in this region, the tension element length compensation will then be provided preferably in a suitably stable design. Such a modification is shown, for example, in FIG. 11.

Furthermore it is suggested according to the invention that in the movement zone of the platform, starting from the lower position, first of all the lifting drive lifts the platform at least at one side. The tension force here acts on the tension element in this way until it is drawn tightly and then the chain stopper is in contact with the stopper catch and the tension element lifts the platform.

In the first section of this movement zone the one-sided lifting movement will turn the platform. With regard to the approach way here the front region is turned, the back region opposite the approach way forms a turning point. The advantage of the invention is exactly the fact that by means of that the suitable adjustment of the stopper catch or the chain stopper, respectively, the turning angle or the turning zone can be set, and thus the constructive conditions can be used optimally. Here the suggestion according to the invention can be realised with a very simple design of the tension element as in the released position (when the platform is lifted, that means turned, at one end) the tension element is simply deposited in a tension element storage. This tension element storage is, for example, designed as a chain case or the like, and has cleverly a suitable maintenance and service unit for the tension element. These make it possible to grease or even clean the tension element accordingly.

By means of this maintenance or service unit, which is cleverly arranged, for example, in a closed chain case, the tension element, via which considerably forces are guided, can be lubricated or cleaned during operation. This leads to a operation of the entire storage device as reliable as possible.

It is suggested here that during the lifting of the platform the tension element is taken out of the tension element storage, for example pulled out. This modification suggested according to the invention is added to the arrangement with a tension element length compensation also counting to the invention. The advantage of the modification described here is the fact that it can be realised easily in mechanical respect, a tension element length compensation is designed, for example, as spring or the like, and accordingly more expensive in constructive respect. Both modifications, however, count to the invention, and present different advantages in their respective fields of application.

Cleverly it is provided that during the lowering movement the released tension element, in particular through a tension element region stiff during pushing, is deposited in a tension element storage. As also shown in the drawing, the tension element is deposited in the tension element storage either rolled or folded. In order to make sure that the tension element gets safely in the tension element storage a tension element region is provided which is stiff during pushing which takes care, when the device is released, for example in the last phase of the lowering movement in the lower position, that the tension element gets safely in the tension element storage. As a rule, the platform is supported already in the back region on the desired end position of the lower position, and only the front region is turned down. In this position the tension element is already released and may get in the tension element storage.

Arrangements where the free end of the tension element (the end which is not attached to the floor or the wall of the pit) is either in a suitable way fixed at the storage device (for example at the stanchion or elements of the stanchion) as well as arrangements where a free, open other end of the tension element is realised, are part of the invention. A mechanical fixing of this other end is not compulsorily decisive as the tension element is actually applied in two phases. In a first phase the tension element is released, in the second phase it gains a function through the contact of the chain stopper with the catch stopper, and is drawn tightly. The region of the tension element projecting behind the chain stopper does not have to be fixed compulsorily but it can be loose, or not fixed as projection.

In a modification according to the invention it is provided that the tension element comprises at the other end a rod, in particular a threaded rod for holding the chain stopper. By the use of a rod, or in particular a threaded rod, it becomes possible to adjust the chain stopper continuously. In this respect the tension element is not designed compulsorily homogeneously, the tension element may actually have even different, heterogeneous tension element regions, accordingly optimised to the respective field of use. Besides a both-sided flexible tension element region it is, for example, possible to arrange a one sided flexible tension element region stiff during pushing as well as a tension element region which is stiff by itself (because it is not deviated) in the region of the rod. Of course, all other modifications are also possible.

Figure 5:
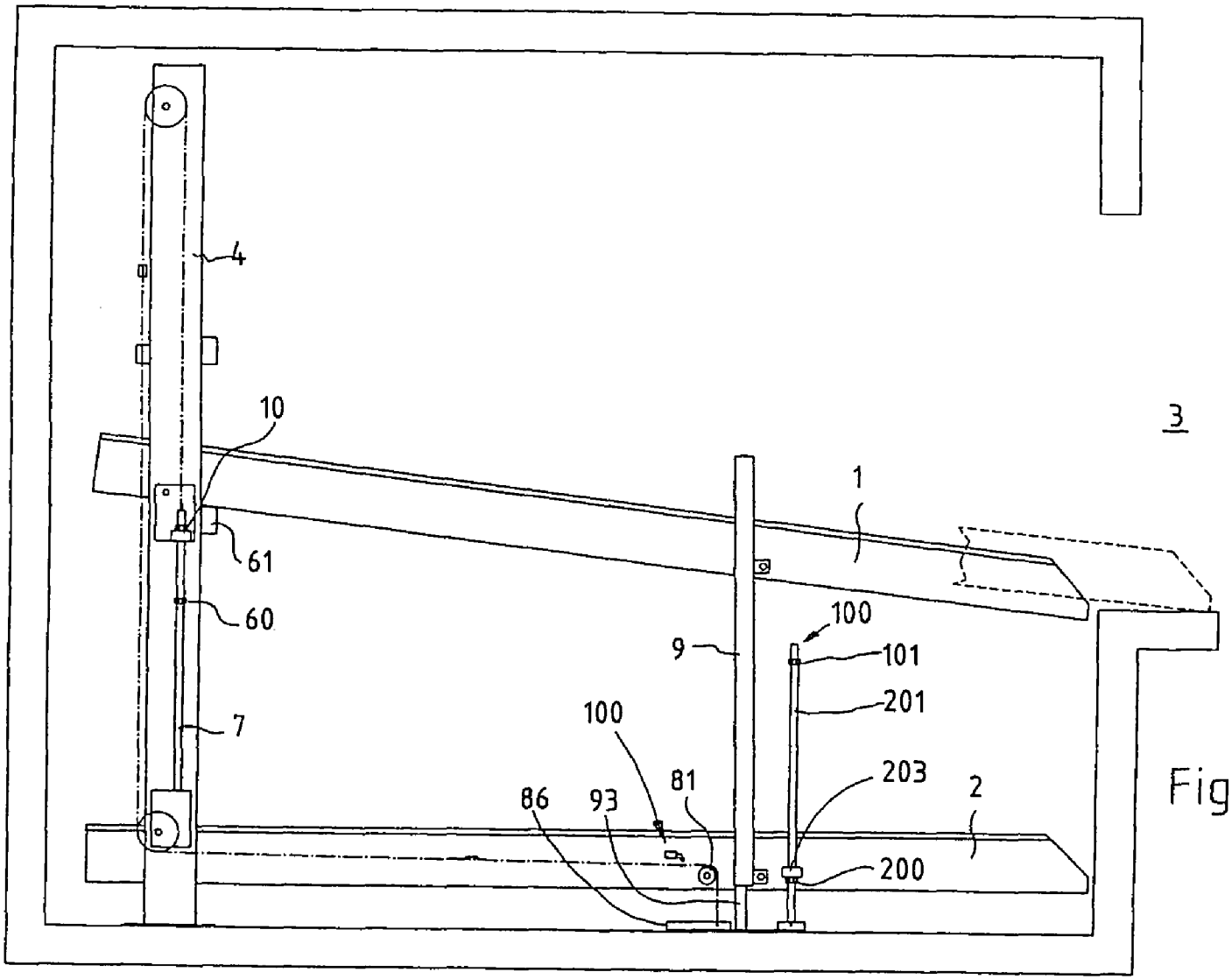
Figure 6:
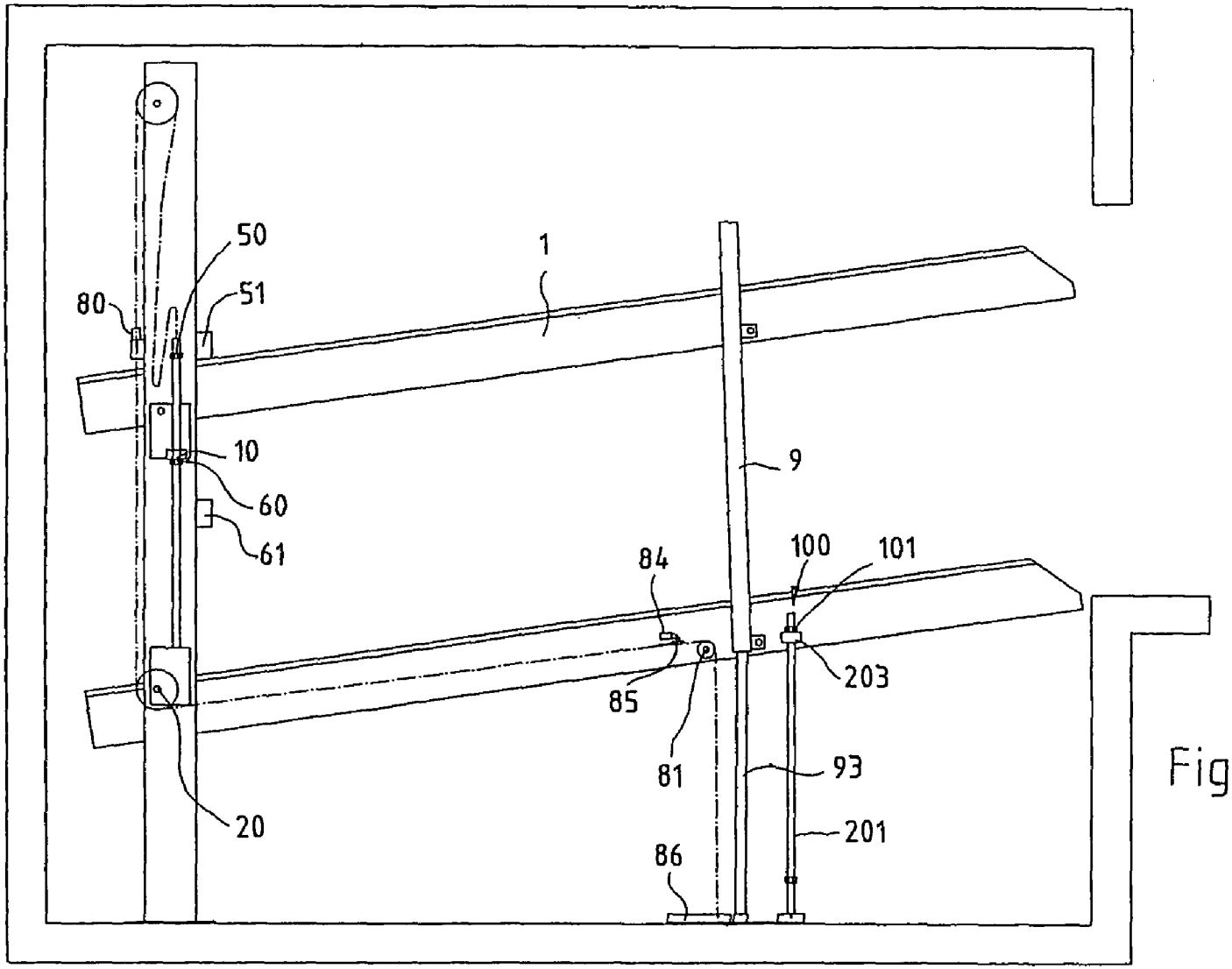
Figure 9:
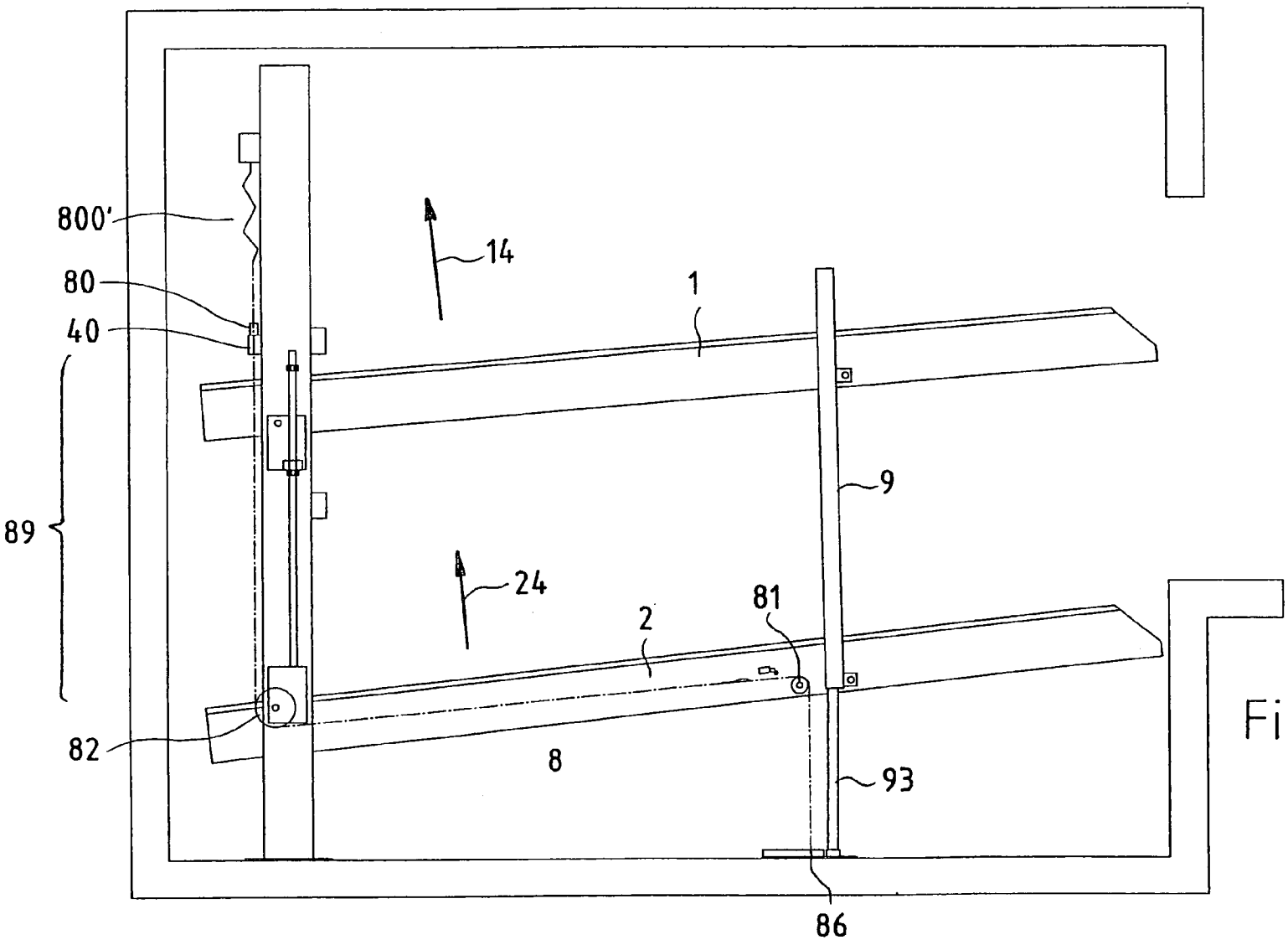
Figure 10:
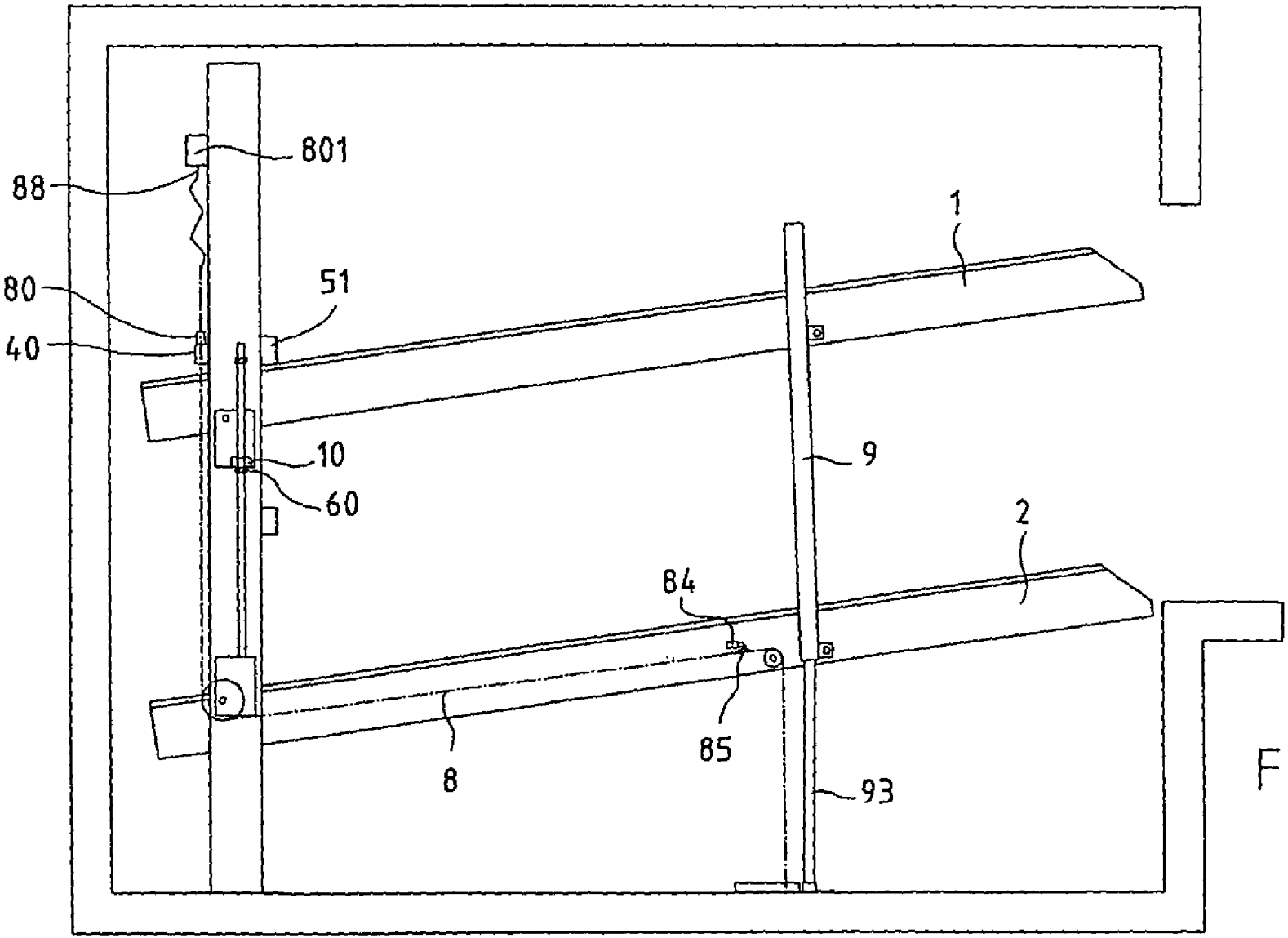
Figure 11:
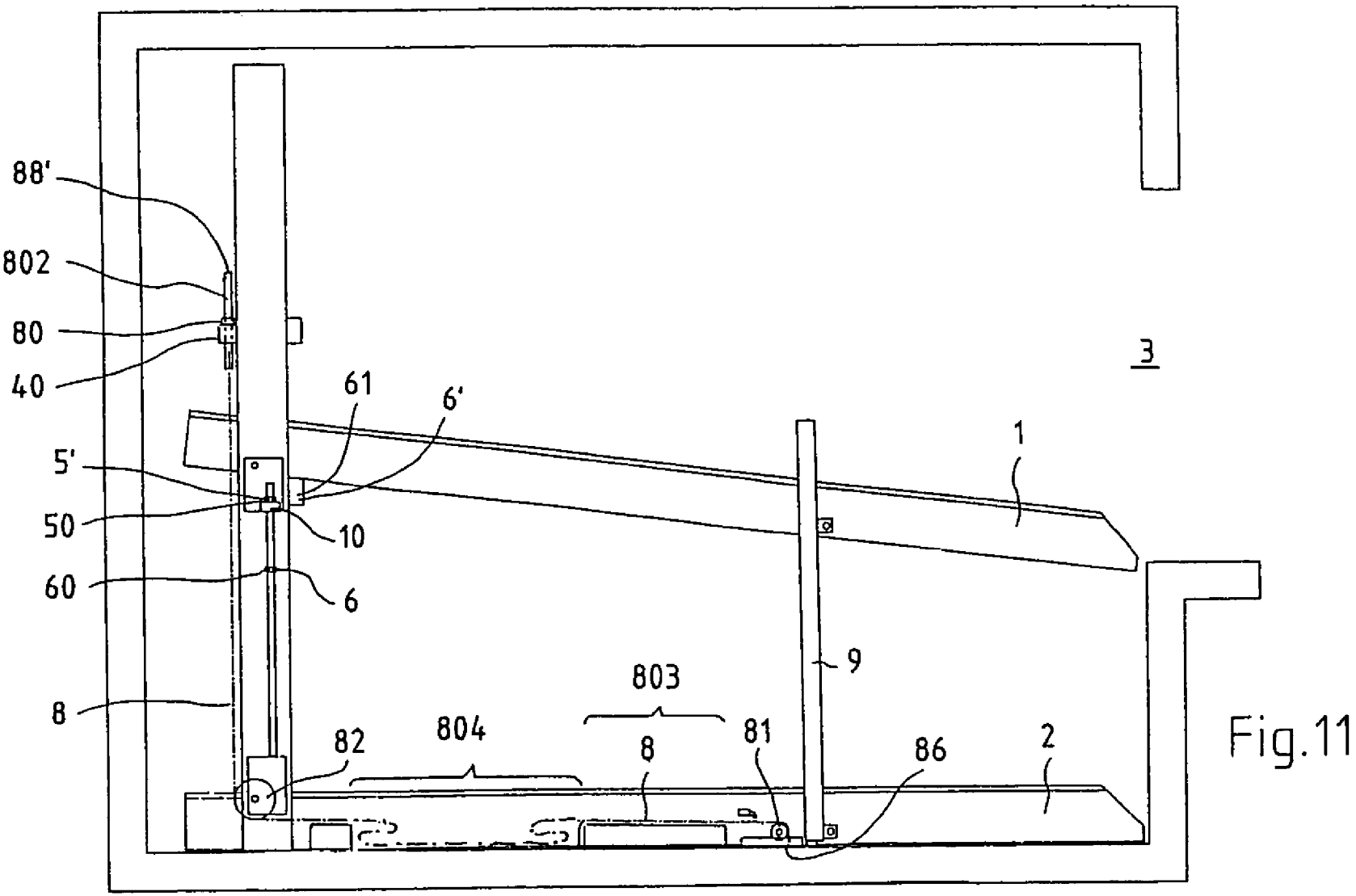

In the drawings the invention is shown schematically. In the drawings:

FIGS. 1 to 4 each a side view of the storage device according to the invention in four different positions between a lower (FIG. 1) and an upper (FIG. 4) position;

FIGS. 5, 6 each a side view of other modifications of the storage device according to the invention;

FIGS. 7 to 10 also each a side view of another modification of the storage device according to the invention in four different positions between a lower (FIG. 7) and an upper (FIG. 10) position, and FIG. 11 also a side view of another modification of the storage device according to the invention in the lowest position.

In FIG. 1 the storage device according to the invention is shown in a first, lower position. In the position shown here a vehicle entering in the approach way 3 can enter the upper platform 1. The entering level of the upper platform 1 is even with the approach way 3.

In contrast to that the lower platform 2 is lowered. The entire arrangement is located, for example, in a pit, so that the vehicle in the lower platform 2 is lowered into the pit.

The storage device according to the invention furthermore comprises a stand 4 arranged on the side of the storage device opposite the approach way 3.

In order to bring the platforms 1, 2 from the first in the second position a lifting drive 9 is provided. This is designed, for example, as working cylinder. As the angle position of the platform 1, 2 changes compared with the essentially vertically arranged lifting drive 9 the upper platform 1 and the lower platform 2 each are connected via flexible bearings 91, 92 to the lifting drive 9. These flexible bearings 91, 92 define a stationary distance F between the upper platform 1 and the lower platform 2. The upper or the lower platform 1, 2 is turned around these bearings 91, 92 when they are lifted or lowered. The lifting drive has several functions. On the one hand, the lifting drive 9 serves for executing a height-adjustable lifting movement H, and, on the other hand, a fixed distance F is defined between the platforms 1, 2 with the turning points by these bearings 91, 92 (see FIG. 4).

On the left and right hand side beside the platform 1, 2 there are suitable lifting drives 9, which are placed one behind the other in the side view and therefore are covered. The lifting drive 9 is arranged in the front half with regard to the approach way 3 at the platforms.

The stand 4 serves as guide for the back end of the platforms 1, 2.

Basically it is also possible to realise a reversed construction or arrangement in such a way that the stand 4 faces the approach way 3.

The stand 4 has a guide path in which suitable, not shown guide sledges of the platforms 1, 2 are guided.

In order to fix the upper platform 1 because of its flexible support with the joint 91, at the storage device, on the one hand, a stopper 5, and, on the other hand, a support 6 is provided. In the position shown in FIG. 1 the support 6', 61 attached to the stand is active, on it the upper platform 1 is supported. Furthermore, this position is fixed by the stopper 50 positioned at the lifting rod 7. For that purpose the upper platform 1 has a carrier 10. This carrier 10 is positioned, for example, on a carrier slab 12 which is connected flexibly by the joint 11 to the upper platform 1. The carrier 10 thus is part of the upper platform 1. A car entering from the approach way 3 first of all weights the region of the platform 1 on the right hand side of the joint 91. An overturning moment occurs clockwise which cannot be compensated by the support 6' at the stand 4.

As the carrier 10 has the same overturning movement as the upper platform 1, the carrier 10 hits the support 5' of the lifting rod 7.

The location of the upper platform 1 is fixed in this position. According to the invention the interaction of a stopper 5 and a support 6 is described. In another modification of the invention it is provided to arrange stopper 5 and support 6 at the stand 4.

According to another modification of the invention it is provided to arrange stopper 50 and support 60 at the lifting rod 7. The lifting rod 7 has a lower zone 70 to which the lifting rod 7 is connected with the lower platform 2.

The stopper 5' receives maximally the counter force which corresponds with the weight force of the lower platform 2 including the lifting rod 7 as well as a possible weight of a vehicle.

The result is therefore that in the position shown in FIG. 1 the stopper 5' 50 eventually is formed by an element of the lower platform 2, in contrast to that the support 6 is located at the stand.

An essential advantage of the invention is the arrangement with the use of an in particular pulley block-like or even deviated tension element 8.

The tension element 8 is connected, for example, with its first end 86 to the floor of the pit. The tension element 8 is then deviated to the left by a first deflection roller 81. The first deflection roller 81 is located here at the lower platform 2. The tension element 8 extends essentially parallel to the longitudinal extension of the lower platform 2. In the region of the stand 4 at the lower platform 2 a second deflection roller 82 is provided. By means of this the tension element 8 is deviated rectangularly from above in the direction of the third deflection roller 83.

The third deflection roller 83 deviates the tension element 8 around 180°. The other end 87 of the tension element 8 ends at the upper region of the lifting rod 7.

The lifting rod 7 can thus be altered via the tension element 8 when the lifting drive 9 is operated, according to the following figures, by a lifting movement V1. The lifting movement V1 is defined by an (adjustable) position of the support 60 with regard to the carrier 10. When the tension at the tension element 8 continues the lifting rod 7 pulls the upper platform via the lifting movement V2 into the upper position by means of the carrier 10 in contact with the support 60. The lifting movement V2 is the (variable) distance of the upper edge of the upper platform 1 from the stopper 51. It is clear that by means of the adjustment of V1 and V2 the angle on which the platforms can be driven on can be set. For retrofitting purposes or for a considerable simplifying of adjustment on site (for example during mounting or reconstructing) as well as for a dynamic adjustment of the geometric of the platform (distance or height) to different types of vehicles this is a considerable advantage. The dynamic adjustment can be supported here, for example, also by control adjustment devices. The stoppers 5, 51 or the supports 6, 61, respectively, are equipped here with controllable, positioning adjustment drives. This is another advantage of the invention.

Figure 2:
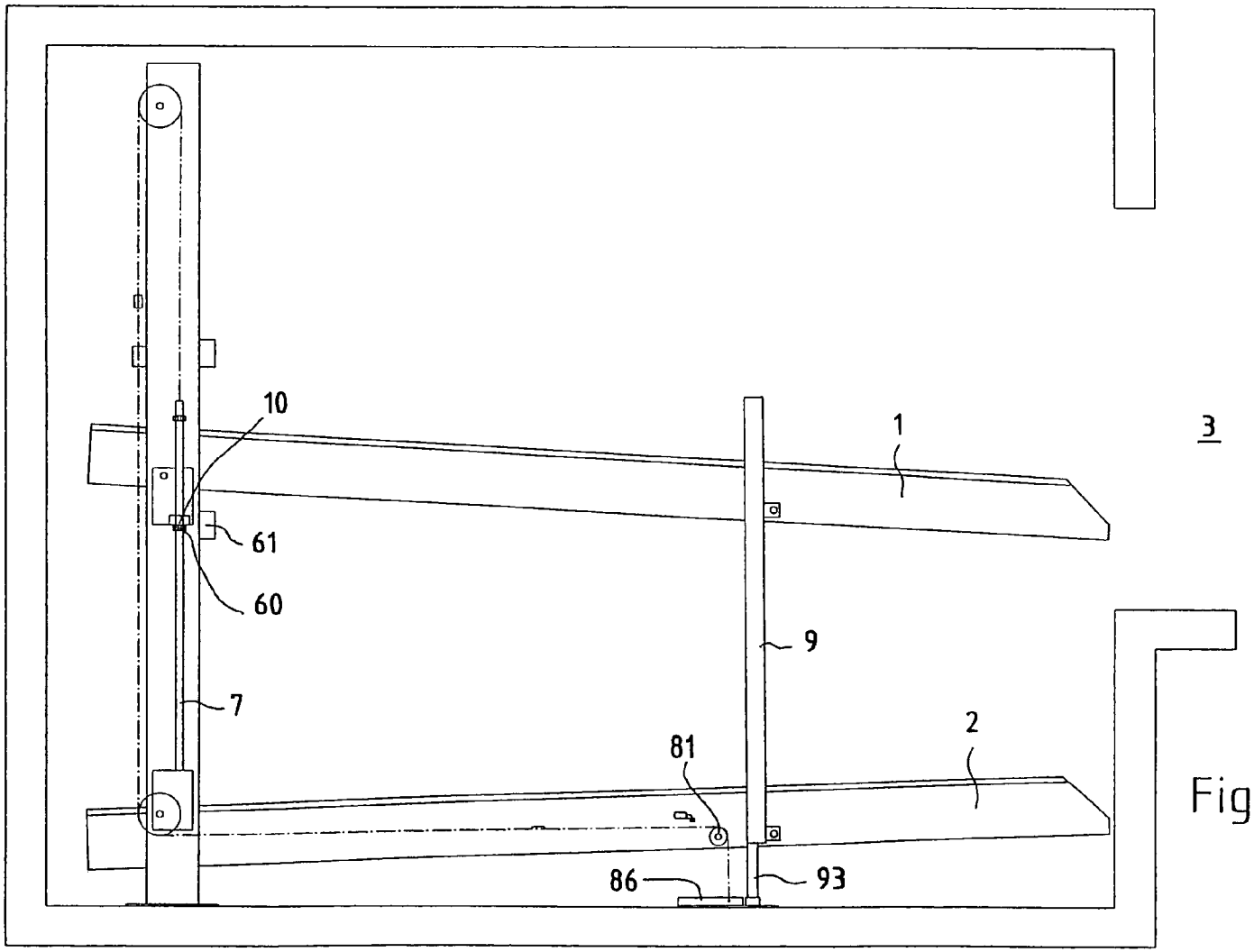

In the intermediate position shown in FIG. 2 entering or leaving the upper platform is not possible anymore. The upper platform 1 is already lifted slightly above the level of the approach way 3. For that purpose the lifting drive 9 is activated, the piston rod 93 of the lifting drive 9 dives out. This enlarges the section of the tension element 8 between its end 86 and the first deflection roller 81. As the complete length of the tension element 8 is constant this increasing in this region has to be combined with a decreasing in another region. The back region of the upper platform 1 is lifted slightly above the support 61. This lifting movement is half of the diving-out movement of the piston rod 93. The reason for that is that the tension element 8 is deviated via a third deflection roller 83, and the path can be divided accordingly in two in order to make available the entire effective length of the tension element 8 in the region between the deflection roller 81 and its end 86.

The carrier 10 of the upper platform 1 is supported on the support 60 which is arranged on the tension rod 7. By means of that the lifting force is transferred to the back end of the upper platform 1. The back end of the lower platform 2 is also lifted, and is already slightly inclined. For that it is convenient that the platform 2 as well as the platform 1 each are connected flexibly with the sledge of the stand 4. For the lower platform 2 the support 60 forms a stopper which defines the maximum of approach condition of the two platforms 1, 2. It is clear that the stoppers 50, 5' or the supports 60 can be adjusted at the lifting rod 7 via threads, and are designed preferably as threaded nuts.

Figure 3:
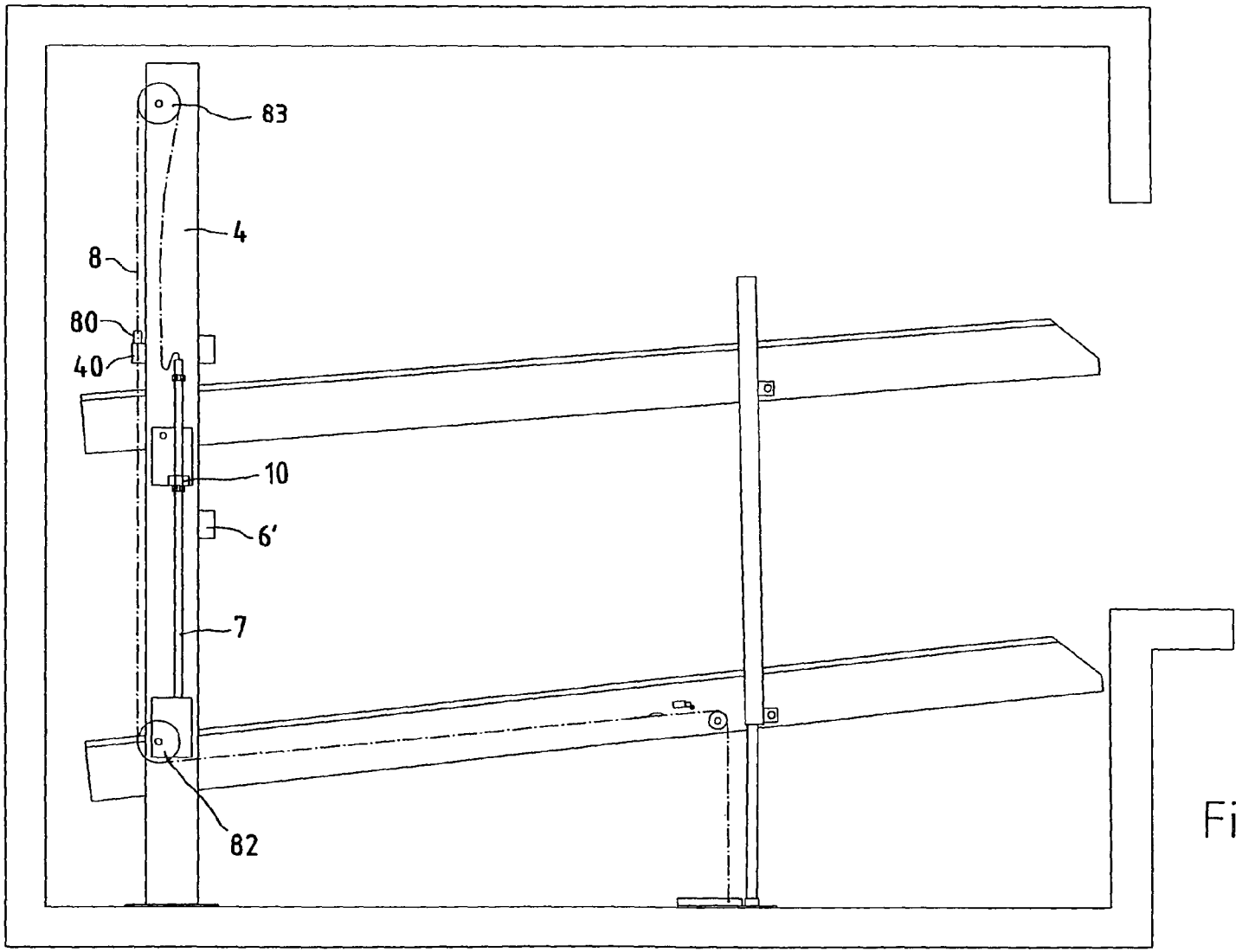

The second intermediate position shown in FIG. 3 is still not suitable for driving on the platform 1, 2.

In the region between the second deflection roller 82 and the third deflection roller 83, about in the upper third of the stand 4, the tension element 8 carries a chain stopper 80 which comes into active connection in the second intermediate position now shown with the catch stopper 40. It can be seen clearly that the platforms 1, 2 go through quite an angle region, that means they are inclined accordingly. This inclination is a result of the uneven motion of the front and back end of the platforms 1, 2. In the moment shown now in FIG. 3 the upper part of the tension element 8, namely the one deviated via the third deflection roller 83, is "switched off". This is shown by the loosely slacking end of the tension element 8 connected with the lifting rod 7. At the present moment the lifting rod 7 is not pulled upwards by the tension element 8 anymore, but pushed upwards by the tension element 8 via the second deflection roller 82.

As before the carrier 10 connected turnably with the upper platform 1 is supported on the support 6', 60 of the lifting rod 7. The support 60 has a double function.

It forms a stopper for the lower platform 2, as described above, and for the upper platform 1 it is a support.

Figure 4:
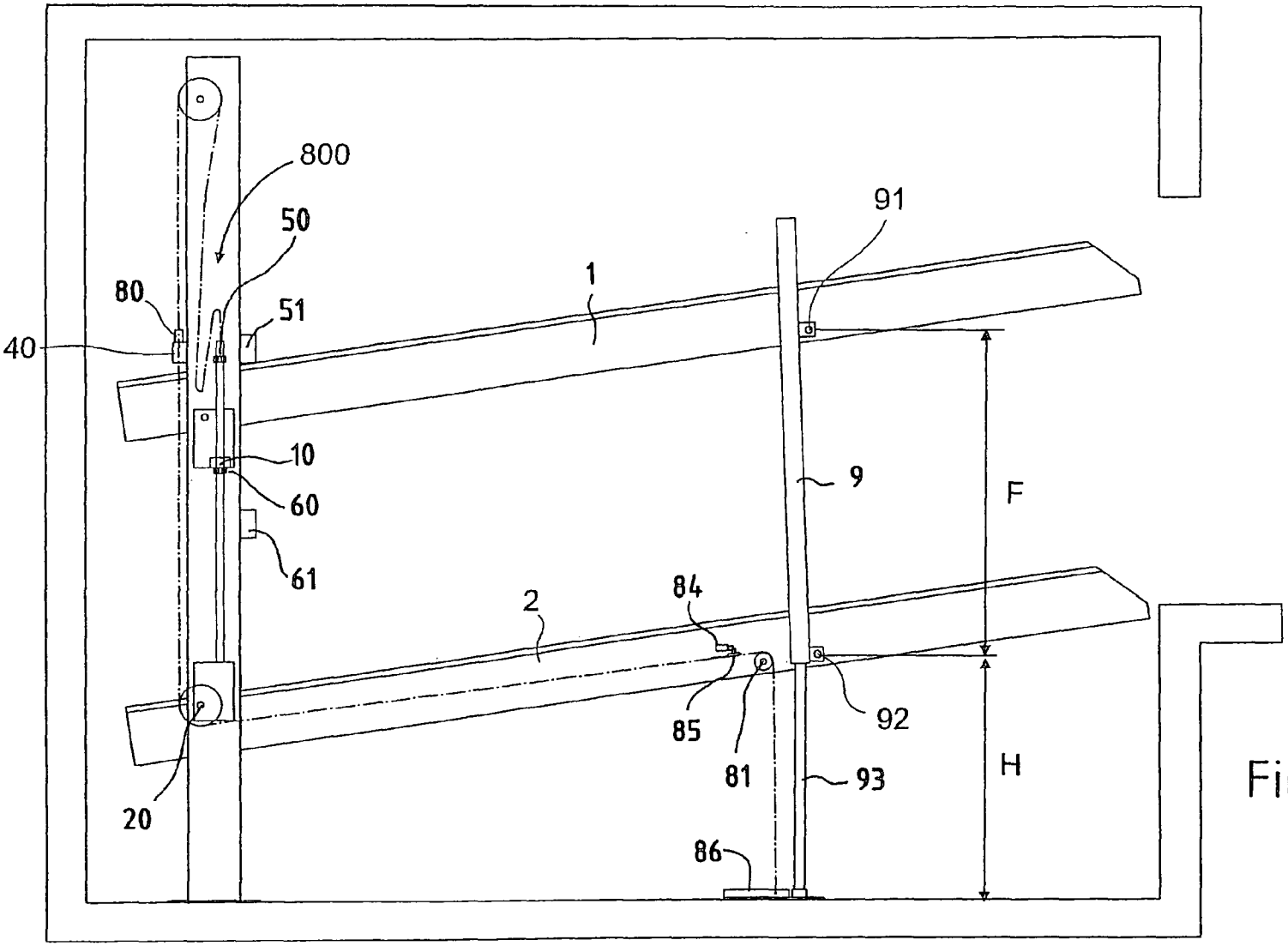

In the upper position shown in FIG. 4 the piston rod 93 is extended still further until the maximum of the lifting movement H, the effective length of the tension element 8 between the first roller 81 and the connecting point 86 is even more enlarged to the maximum distance, the distance between the upper platform 1 to the stopper catch 40 arranged above it has become even smaller. As the position of the lifting rod 7 is not exactly above the joint point 20, by means of this movement a slight turning movement is impressed anti-clockwise in the upper platform 1. The upper and lower platform 1, 2 are supported above the lifting drive 9 and the supports 91, 92 arranged at it in every operation position of this arrangement in a fixed distance F.

The stopper 51 is a stopper for the upper platform 1 which forms through a kinematic with the carrier 10 and the support 60 indirectly also a stopper for the lower platform 2.

The connecting link 85 arranged on the tension element 8 touches in the position shown now the limit switch 84 and stops the lifting operation 9.

The interaction of the limit switch 84 and the connecting link 85 is called according to an advantageous modification of the invention also device for limiting the lifting movement 100. Here there are different modifications according to the invention how this device for limiting the lifting movement 100 is designed. Besides the modification just described it is possible that a block arranged on the tension element 8 is provided interacting with the stopper. The stopper is arranged fixedly, for example, at the frame or at the lower or upper platform 1, 2, and limits the movement with regard to the tension element 8. The hydraulic here has a limit switch which stops the pump accordingly when it's overloaded. This overload is reached when, despite further generating of pressure, the platform cannot be moved, namely when the arrangement has reached the stopper.

In FIG. 5 another modification of a device for limiting the lifting movement 100 according to the invention is shown. In the example shown here a platform stopper 203 which, when the lower platform is lifted, interacts with the stopper 10 sits on the lower platform 2. Again the further lifting movement is limited by that.

Cleverly the arrangement is carried out in such a way that the stopper 101 is provided at a guide rod 201 designed, for example, as threaded rod, and the stopper 101 can be adjusted, for example, as nut on this threaded rod. Thus in a simple way a limiting device for the lifting movement can be realised adjustably.

The design with the guide rod 201 here offers another surprising advantage. It is possible to provide at the guide rod 201 in the lower region a position stopper 200 so that the lowered position of the lower platform 2 is adjustable. This can be an advantage, for example, with different depths of the pit where the storage device according to the invention has to be mounted; the versatility and application of the invention is thus increased further.

The invention is not defined here only to realise, as described, a suitable position stopper, according to a common modification of the invention for the lower platform 2 a position stopper 200 which is in particular adjustable is provided. Here also other modifications may be provided, however, of course the use of a threaded rod has considerable advantages with regard to a continuous adjustment of the position stopper 200.

Thus, for example, FIG. 5 shows the interaction of the pallet stopper 203 with the position stopper 200 in the lowered position. If the solution according to FIG. 5 is compared with the modification according to FIG. 1 it can be discerned clearly that, in contrast to the solution according to FIG. 1, the pallet is not supported completely by the floor of the pit, but it is spaced slightly. This dimension can be set by the position of the position stopper 200.

In FIG. 6 the limiting device for the lifting movement 100 by means of the guide rod 201 is shown in operation. The pallet stopper 203 running together with the lower pallet 2 hits from below the stopper 101 and thus limits the further vertical movement. Thus another parameter for adjusting the storage device according to the invention is created.

In another modification according to the invention it has turned out to be convenient if an upper platform 1 projecting in the approach way is provided. This is shown for example in FIG. 5. The projecting end of the upper platform is indicated in a dashed line. The result is that, when the position of the storage device is the same, that means the position of the platform 1 at the stand 4 is the same, the inclination angle of the upper platform 1 is different. The solution where the approach way 3 projects in the approach road or the approach way 3 is here a bit more flat, the resulting distance, the height which can be used for parking the vehicle between the lower surface of the upper platform 1 and the lower platform 2 is accordingly higher. By means of that another modification can be included, in order to create even with difficult or narrow conditions on the lower parking space of the lower platform 2 a sufficiently high parking space.

The lower platform 1 is now in contact with the stopper 51 of the stand 4, and continues to be held by the support 60 of the lifting rod 7 by the carrier 10. By means of that the angle formed by the longitudinal extension of the lifting rod 7 and the longitudinal extension of the upper platform 1 is stiffened and secured, that means fixed at the stand so that the lower platform 2 does not tilt downwards when a vehicle is driven on it.

The storage device according to the invention makes possible, in particular by the position of the support 61 and the stopper 51 arranged at the stand as well as the stopper 50 and the support 60 arranged at the lifting rod and thus mobile with only one lifting drive 9 arranged at a region, by using the tension element 8, a very complex multitude of different kinematics of the upper and lower platform 1, 2. Depending on the chosen distance from stopper 5, 50, 51 to the support 6, 60, 61, the moment when the chain stopper 80 switches off the part of the tension element 8 guided via the third deflection roller 83, by means of the storage device according to the invention a multitude of different types can be realised.

Figure 7:
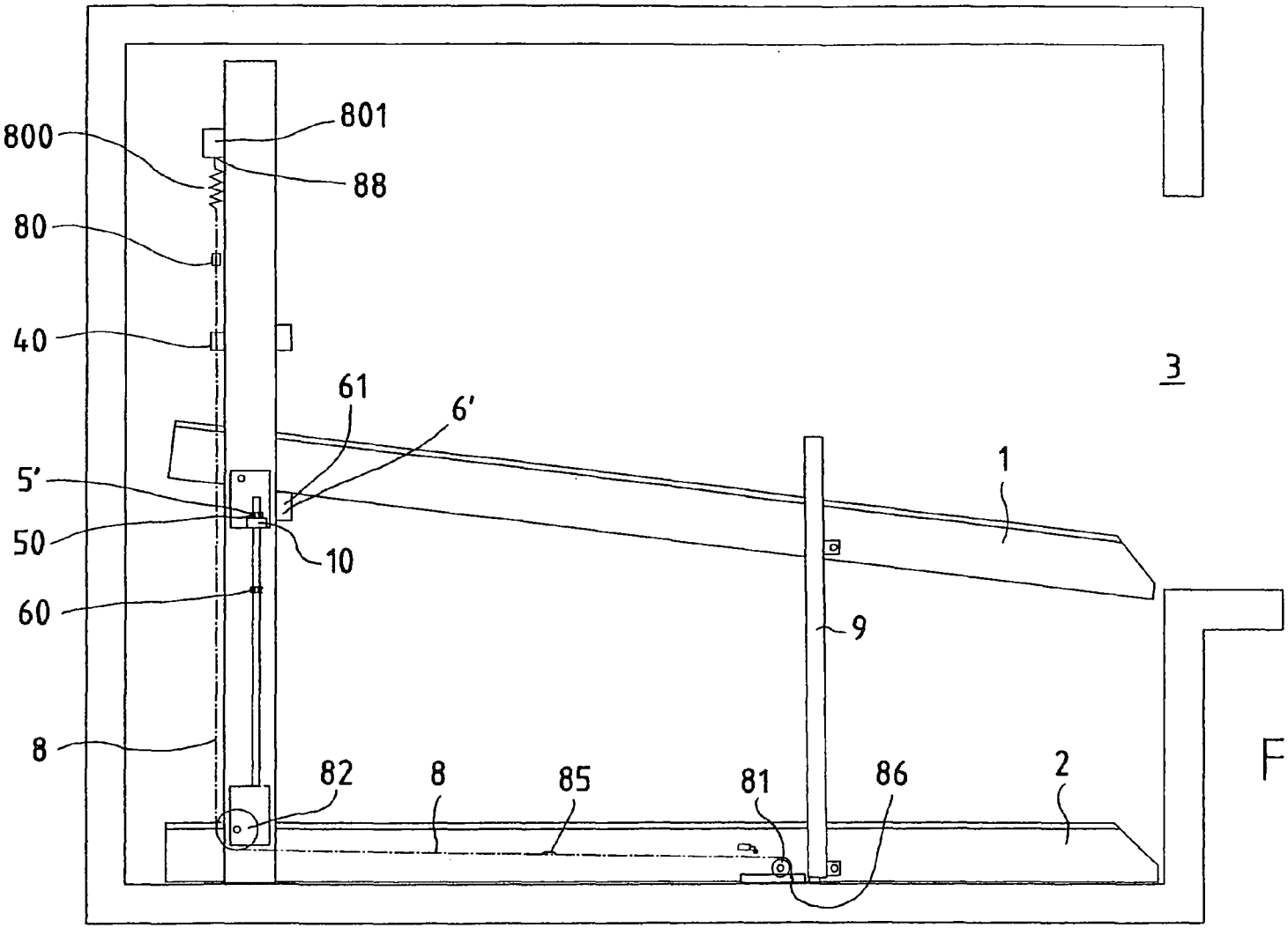
Figure 8:
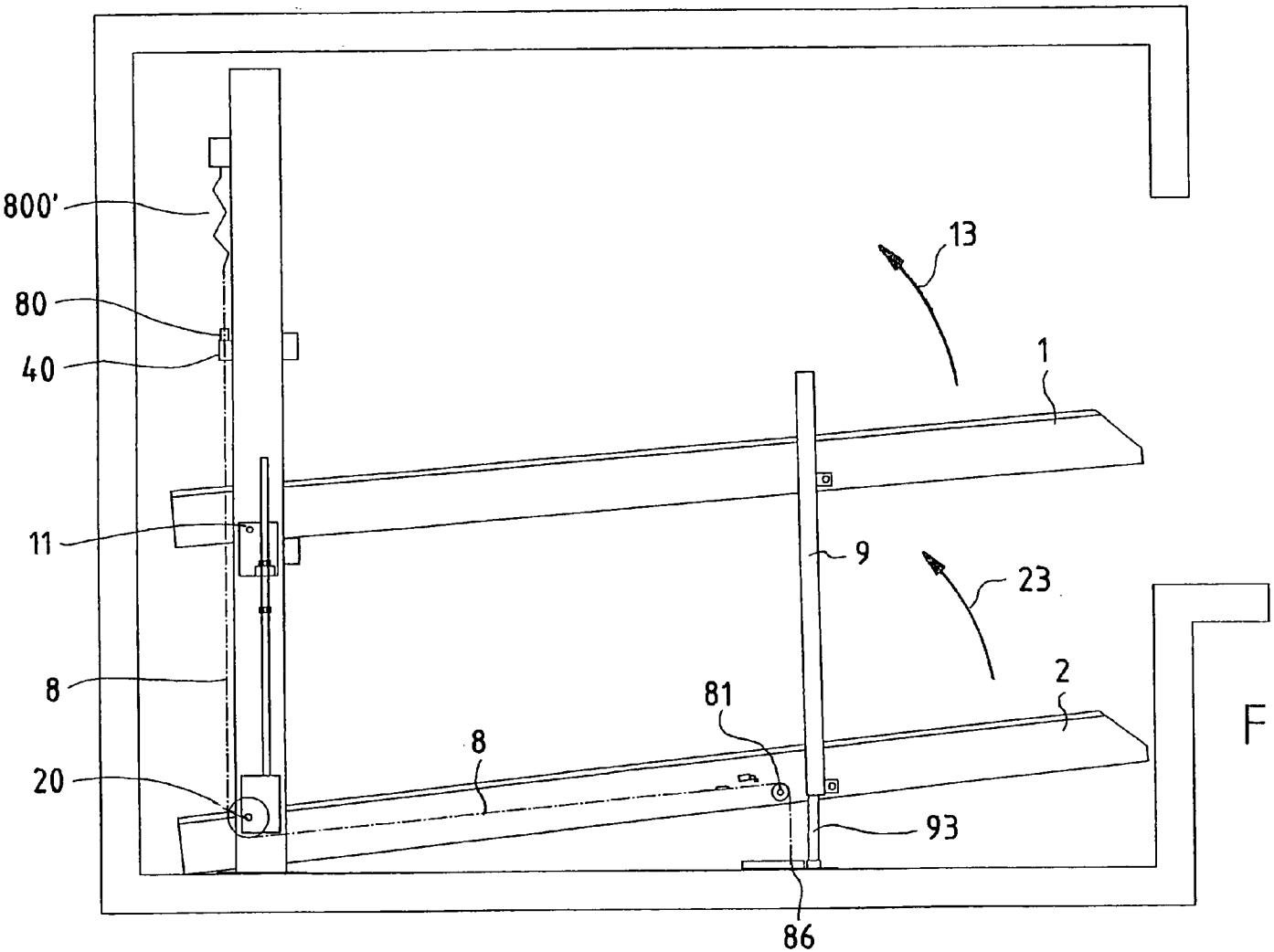

In FIGS. 7, 8, 9 and 10 another modification according to the invention is shown. The storage device according to the invention shown in different positions corresponds with the respective views, the positions with the FIGS. 1 to 4 in such a way that the respective lowest position is shown in FIG. 1 or FIG. 7 and the respective uppermost position is shown in FIG. 4 or FIG. 10, respectively. Numbering is also correspondingly identical. The interaction of the different stoppers 5, 5' or the supports 6, 6' and so on is therefore not discussed again at this point, the modification shown in FIGS. 7 to 10 has in this respect the same effect as the ones shown in FIGS. 1 to 4.

The modifications according to FIGS. 7 to 10 are different compared with the modification according to FIGS. 1 to 4 in view of the guide of the tension element 8.

In the first modification according to FIGS. 1 to 4 at the upper end of the stand 4 a third deflection roller 83 is provided which has the effect that the end of the tension element 8 opposite the stationary end 86 is guided again downward, and the loose end 88 joins the lifting rod 7.

The modification shown in FIGS. 7 to 10 does without the third deflection roller 83, the corresponding length of the tension element 8 from the deflection roller 83 to the lifting rod 7 and the connection of the tension element 8 to the lifting rod 7 is not necessary. It is suggested that the loose end 88 of the tension element 8 joins in a bearing 801 at the stand 4 in the upper region and is suspended. The modification according to FIGS. 7 to 10 is thus more convenient than the modifications according to FIGS. 1 to 4.

FIGS. 3 and 4 show that advantageously for holding the excess length of the tension element 8, in particular during lifting and lowering operation of the storage device preferably a tension element length compensation 800 has to be provided. This tension element length compensation 800 holds the excess length of the tension element 8 which is shown in FIGS. 3 and 4 as slacking loose angled end. The tension element length compensation 800 is here provided between the third deflection roller 83 and the end 87.

The same is also shown in the modification according to FIGS. 7 to 10, although here the tension element length compensation 800 is designed, for example, as spring and may suitably be lengthened in a controlled way so that the whole matter can be mastered better.

In the following first of all the lifting process according to FIGS. 7 to 10 is described in sequence.

In FIG. 7 the lower position is shown, a vehicle can drive out of the approach way 3 to the upper platform 1. By means of the fixing of the platforms 1, 2, which is also part of the invention, with the stoppers 5, 5', 50 or 51 and supports 6, 6', 60 and 61 the platforms 1 or 2 are fixed securely in the respective loading and unloading positions.

The lifting drive 9 designed as working cylinder is compressed completely, the arrangement is in the lower position.

It has to be taken into consideration that the chain stopper 80 located between the catch stopper 40 and the bearing 801 has, first of all, sufficient distance to the catch stopper 40. In the example shown here the tension element length compensation 800 is arranged between the chain stopper 80 and the bearing 801, however, there are even other modifications for that.

When now the working cylinder of the lifting drive 9 is pressurised the piston rod 93 emerges, the first deflection roller 81 leaves the floor with the fixed end 86 of the tension element 8. The movement of the piston rod 93 effects eventually a force on the tension element 8. The entire length of the tension element 8 increases by the emerging of the piston rod 93, this length is taken out of the tension element length compensation 800, this is shown, slightly lengthened, as 800'.

A force may act on the tension element 8 by means of the movement of the lifting drive 9, this impressed force, however, leads only to a corresponding lengthening of the tension element 8, but there is no lifting of the end of the platform opposite the approach way 3. The front part of the platform arranged in the region of the lifting drive 9 is lifted. This one-sided movement leads to a rotating movement, indicated by the curved arrows 13, 23 (see FIG. 8) of the platform 1, 2 around the joints 11, 20. This turning movement 13, 23 continues until the chain stopper 80 meets the catch stopper 40. In this situation it happens that the further force impression in the tension element 8 cannot lead to a lengthening of the tension element 8 as now the actual active tension length is fixed by the contact of the chain stopper 80 with the catch stopper 40. In this moment the direction of movement of the platforms 1, 2 will change, as it is shown in FIG. 9.

A further emerging of the piston rod 93 at the lifting drive 9 or analogously a further lifting of the platforms 1, 2 in the front region by any lifting means has now the effect that also the distance of the first deflection roller 81 to the tension element end 86 fixed at the floor increases. However, as the tension length of the tension element 8 is fixed by the contact of the chain stopper 80 at the catch stopper 40 and is thus constant, the tension element length occurring in the region between the first deflection roller 81 and the end of the tension element 86 has to be taken from the region of the tension element 8 between the chain stopper 80 and the second deflection roller 82. As this region, indicated by 89 in FIG. 9, is reduced accordingly the second deflection roller 82 moves toward the catch stopper 40 stationary at the stand, it is lifted. The result is an even lifting of both platforms 1, 2, along a straight movement path, illustrated by the arrows 14, 24.

This vertical lifting movement 14, 24 continues until the platforms 1, 2, as also described in FIG. 4, reach their upper final positions. As also described in FIG. 4, then the platforms 1, 2 interact with the respective stoppers or supports. The way of function for fixing the platforms 1, 2 in these positions is identical. In particular, the lifting drive 9 is switched off by operating the limit switch 84 by the connecting link 85, and, if necessary, fixed or blocked in order to prevent an undesired lowering reliably.

The modifications shown in FIGS. 1 to 4 and 7 to 10, respectively, reach different movement processes or kinematics.

In the first modification according to FIGS. 1 to 4 the pulley block-like design of the tension element 8 results in a different speed of the upper platform 1 and the lower platform 2, and that is in the respective back region. As, however, the front region is each time arranged at the cylinder of the lifting drive 9 and thus is equally fast each time the result is a turning movement. The movement of the two platforms 1, 2 is thus not parallel.

This goes until the chain stopper 80 does not yet interact with the catch stopper 40. When it is then in contact (see FIG. 3 or FIG. 8) the respective movement of at least one platform 1, 2 changes.

In contrast to that in the second modification according to FIGS. 7 to 10, first of all, a turning (see movement 13, 23) and after that a vertical movement (arrows 14, 24) is provided.

An essential advantage of the invention is the fact that when the basic construction of the storage device is the same and only the design of the tension element 8 differs different kinematics can be realised. Just in the interaction with the multiple adjustments of the stoppers 5' or the supports 6 and so on the storage device according to the invention is equipped with a high versatility in design.

The tension element length compensation 800 can be built in, according to the invention, at any point in the tension element 8.

As shown in FIG. 7, it is arranged, for example, in the upper region, that means between the chain stopper 80 and the tension element 88 fixed at the stand. However, it is also possible to arrange the tension element length compensation between the chain stopper 80 and the second deflection roller 82, or between the deflection roller 82 and the first deflection roller 81. It is also possible to arrange the tension element length compensation 800 between the first deflection roller 81 and the end 86 of the tension element 8 fixed at the floor. It has to be taken into consideration that in this field of application, when the chain stopper 80 is then in contact with the catch stopper 40, a considerable tension load is on the lower region (between the fixed end 86 and the catch stopper 40) on the tension element 8, and then accordingly also the tension element length compensation 800 has to be suitably stable.

It is, of course, possible to arrange the tension element length compensation 800, as indicated in FIG. 3 or 4, in the last segment of the tension element 8. In this respect the invention is very variable.

In FIG. 11 another modification according to the invention is shown as an example. The modification shown here is very similar to the one in FIG. 7 so that in the following only the differences to FIG. 7 will be mentioned.

Instead of a length compensation 800 according to FIG. 7 in this modification a tension element storage 804 is provided. It is mentioned here that the tension element storage commonly is also provided as special design of the tension element length compensation, however, in another modification it can also be used independently and without regard to a tension element length compensation.

The tension element storage 804 serves for holding of the not required tension element 8 slacking in the lower position. It is indicated that the tension element 8 is put meander-like in the tension element storage 804. This is in particular effected by a rigid push chain region 803 which, for example can only be angled to the left, but otherwise is rigid. During the lowering movement exactly this push chain region 803 is pushed to the left so that the tension element 8 gets in the tension element storage 804 and is deposited there. In this situation no lifting force or holding force is transferred via the tension element 8 to the back region of the platforms 1, 2.

When now the platform 1, 2 is lifted by the lifting drive 9, and the distance of the first deflection roller 81 from the floor of the pit enlarges the tension element 8 is taken out of the tension element storage 804. The tension element 8 is drawn tightly until the chain stopper 80 is in close contact with the stopper catch 40. During another lifting movement the entire length of the tension element 8 is now fixed, and the deflection rollers 81, 82 roll over the tension element 8, the back region of the platform 1, 2 is also lifted. It is clear that by means of the position of the chain stopper 80 the moment at which the transfer from a turning movement to a lifting movement occurs can be set. The same goes of course also analogously for the lowering movement.

In the modification shown in FIG. 11 the chain stopper 80 is supported at all times by the support 40. As there is no lifting force active there is no force transfer either. Cleverly the tension element 8 is equipped in this region with a rod 802, a free projecting end 88' of the tension element 8 is formed. In this modification according to FIG. 7 the other end 88 is fixed at the bearing 801. However, this is not decisive as in this region no forces are transferred. It is clear that by means of this modification the length compensation is not necessary. The construction becomes considerably cheaper.

However, as no tension force is transferred to the tension element 8 the contact of the chain stopper 80 at the stopper catch 40 does not cause anything either. A lengthening of the tension element 8 does only lead to a tightening until it is drawn tightly, and then the chain stopper 80 acts actually with corresponding force against the stopper catch 40. From this moment on then the back region of the platforms 1, 2 is lifted upwards in particular via the deflection roller 82 when the lifting drive 9 is further active, that means it moves the storage device from the lower to the upper position.

Cleverly the rod 802 is designed as threaded rod. The chain stopper 80 is designed, for example, as nut so that a continuous adjustment of the chain stopper is the result and, of course, any adjustment can be realised.

The claims filed with the application now and to be filed later on are attempted formulations without prejudice for obtaining a broader protection.

If here, on closer examination, in particular also of the relevant prior art, it turns out that one or the other feature may be convenient for the object of the invention, however, not decisively important, of course already now a formulation is striven for which does not contain anymore such a feature, in particular in the main claim.

References in the sub-claims relate to the further design of the matter of the main claim through the characteristics of the respective sub-claim. These are, however, not to be understood as a waiver of independent protection of the matter of the characteristics of the referred sub-claims.

Characteristics only disclosed in the description so far, may now, in the course of proceedings, be claimed as being of inventive relevance, for example to distinguish from the state of the art.

Characteristics only disclosed in the description or even single characteristics from claims which comprise a variety of characteristics may be used at any time to distinguish from the state of the art in the first claim, and this is even if such characteristics have been mentioned in connection with other characteristics, or achieve particularly convenient results in connection with other characteristics.

The invention claimed is:

1. A storage device for vehicles, said storage device comprising several platforms located one above the other, the platforms being lifted and lowered at least between a first lower and a second upper position, and the platforms being connectable to a common approach way, the platforms being guided on at least one stand, the platforms being at a position of rest, fixed in a respective position by a support and a stopper, and, during movement, lifted and lowered by a lifting drive interacting with a tension element, a lifting rod, the lifting rod having the support and the stopper, and a tension element length compensation being provided during the lifting/lowering operation by changing a length of the tension element.

2. The storage device according to claim 1, wherein an upper platform arranged above a lowest platform is fixed in the respective position by the support and the stopper, or for the lower position a lower support and a lower stopper, and for the upper position an upper support and an upper stopper is provided.

3. The storage device according to claim 1, wherein by fixing of a first upper platform, also a second lower platform below the first upper platform, is fixed, or at the stand the stopper and the support are arranged fixedly with regard to one platform, at least during operation of the storage device.

4. The storage device according to claim 1, wherein at least one of the support and the stopper changes a respective position at the stand, or with regard to the stand a longitudinally movable stopper or support is provided.

5. The storage device according to claim 1, further comprising a carrier connected flexibly with the platform, and the carrier interacts with at least one of the support and the stopper of a lifting rod.

6. The storage device according to claim 5, wherein the lifting rod is connected flexibly with a lower platform, or an upper platform is fixed in the lower position by a lower support of the stand and a lower stopper of a lifting rod, and in the upper position by an upper stopper of the stand and an upper support of the lifting rod.

7. The storage device according to claim 1, wherein the lifting drive is connected flexibly with the platform.

8. The storage device according to claim 1, wherein the platforms are guided supported flexibly in sledges movably at the stand, or a pulley block-like tension element is provided for the platform.

9. The storage device according to claim 1, wherein a length of the tension element is at least in sections a result of a position of the lifting drive, or the tension element carries a chain stopper, or a chain stopper for the tension element is provided, and the chain stopper interacts with a catch stopper at the stand.

10. The storage device according to claim 9, further comprising a chain stopper for the tension element, and by contact of the chain stopper with the catch stopper a direction of movement of the platform changes in the lifting and lowering movement, or, starting from the lower position the platforms are first of all turned, and, after the contact of the chain stopper for the tension element with the catch stopper the platforms are lifted.

11. The storage device according to claim 1, wherein the lifting drive is arranged essentially centrally or at a side of the platform facing the common approach way.

12. The storage device according to claim 1, wherein one end of the tension element is fixed, independently from a position of the platform, in a wall or in a floor, the tension element, after the tension element is deviated by a first deflection roller at a lower platform, the lower platform has a second deflection roller for deviating the tension element in a direction of a third deflection roller arranged at the stand, and the other end ends at least one of the lower and the upper platform and is connected with the at least one of the lower platform and the upper platform.

13. The storage device according to claim 1, wherein in a motion zone of the platforms, starting from the lower position, a length of the tension element is first of all small, by activating the lifting drive the platforms are turned, the length of the tension element enlarging because of a lengthening of the tension element length compensation until a chain stopper is in contact with a catch stopper, and after that the platforms are lifted, or in a motion zone of the platforms, starting from the lower position first of all the lifting drive lifts the platforms at least on one side, a tension force acts on the tension element until the tension element is drawn tightly, and then a chain stopper is in contact with a catch stopper and the tension element lifts the platforms.

14. The storage device according to claim 1, wherein during the lifting of the platforms the tension element is pulled out of a tension element storage and during the lowering of the platforms the relieved tension element is deposited in the tension element storage through a tension element region which is stiff during pushing.

15. The storage device according to claim 12, wherein the other end of the tension element is connected to a lifting rod or an upper end of the stand, or the tension element carries a chain stopper in a region between the second and third deflection rollers, or between the second deflection roller and the other end of the tension element.

16. The storage device according to claim 12, further comprising a chain stopper, and a position of the chain stopper on the tension element is set, or in a motion zone of the platforms, starting from the lower position, the tension element pulls a lifting rod over the third deflection roller until the chain stopper is in contact with a catch stopper, and, after that, the stopper of the lifting rod is in contact with a carrier, and a further movement of the tension element acts on the lifting rod through the second deflection roller and thus lifts the upper platform.

17. The storage device according to claim 1, wherein movement of the tension element is deviated by a movement of a lower platform because of the lifting drive, or the lower platform moves on from a first to a second position in sections with different speed depending on a position of a chain stopper.

18. The storage device according to claim 1, wherein a synchronising device is provided for sides of the platforms, or a device is provided for limiting the lifting movement.

19. The storage device according to claim 1, wherein a position stopper adjustable for a lower platform is provided, or a tension element length compensation is designed as a spring, telescopic cylinder, or a tension element storage.

20. The storage device according to claim 12, wherein a tension element length compensation is arranged between a chain stopper and a tension element end connected either to the stand or a lifting rod, or a tension element length compensation is arranged between a fixed end of the tension element and the first deflection roller, between the first deflection roller and the second deflection roller, or between the chain stopper and the fixed end of the tension element.

21. The storage device according to claim 1, further comprising a servicing or maintaining unit for the tension element arranged in a tension element storage.

22. A storage device for vehicles, said storage device comprising several platforms located one above the other, the platforms being lifted and lowered at least between a first lower and a second upper position, and the platforms being connectable to a common approach way, the platforms being guided on at least one stand, the platforms being at a position of rest, fixed in a respective position by a support and a stopper, and, during movement, lifted and lowered by a lifting drive interacting with a tension element, and a lifting rod, the lifting rod having the support and the stopper, a position of the support and the stopper being changed and set on the lifting rod.

23. A storage device for vehicles, said storage device comprising several platforms located one above the other, the platforms being lifted and lowered at least between a first lower and a second upper position, and the platforms being connectable to a common approach way, the platforms being guided on at least one stand, the platforms being at a position of rest, fixed in a respective position by a support and a stopper, and, during movement, lifted and lowered by a lifting drive interacting with a tension element, a lifting rod, the lifting rod having the support and the stopper, and a guide rod which having in an upper region a device for limiting the lifting movement, and in a lower region a position stopper, and a lower platform having a running stopper guided on the guide rod and interacting with the device for limiting the lifting movement or the position stopper.

* * * * *

UNITED STATES PATENT AND TRADEMARK OFFICE

CERTIFICATE OF CORRECTION

PATENT NO. : 8,371,793 B2
APPLICATION NO. : 11/793213
DATED : February 12, 2013
INVENTOR(S) : Fäβler et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 982 days.

Signed and Sealed this
First Day of September, 2015

Michelle K. Lee

Michelle K. Lee
*Director of the United States Patent and Trademark Office*